US011766884B2

(12) United States Patent
Kinoshita et al.

(10) Patent No.: US 11,766,884 B2
(45) Date of Patent: Sep. 26, 2023

(54) FRAME COUPLING STRUCTURE AND RECORDING DEVICE

(71) Applicant: SEIKO EPSON CORPORATION, Tokyo (JP)

(72) Inventors: Masaaki Kinoshita, Shiojiri (JP); Kazuo Otsuka, Azumino (JP); Atsuhiko Takeuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/645,552

(22) Filed: Dec. 22, 2021

(65) Prior Publication Data

US 2022/0203729 A1 Jun. 30, 2022

(30) Foreign Application Priority Data

Dec. 25, 2020 (JP) ..... 2020-216423

(51) Int. Cl.
*B41J 29/02* (2006.01)

(52) U.S. Cl.
CPC ..... *B41J 29/02* (2013.01)

(58) Field of Classification Search
None
See application file for complete search history.

(56) References Cited

U.S. PATENT DOCUMENTS

2012/0229567 A1* 9/2012 Sawata ..... B41J 29/023 347/37

FOREIGN PATENT DOCUMENTS

CN 1727193 A * 2/2006 ..... B41J 29/02
JP H08-326719 A 12/1996

* cited by examiner

*Primary Examiner* — Justin Seo
*Assistant Examiner* — Tracey M McMillion
(74) *Attorney, Agent, or Firm* — WORKMAN NYDEGGER

(57) ABSTRACT

A main frame extending in a first direction, a side frames extending in a second direction that intersects with the first direction, the side frames being fixed to the main frame, and a supported member extending in the first direction and supported by the side frame are included, wherein the side frame includes a first frame portion extending in the second direction and a second frame portion extending from the first frame portion in the first direction, the second frame portion being in surface contact with the main frame, and in plan view from the second direction, an abutting portion that abuts the main frame is provided at the first frame portion and a fixing portion is provided at the second frame portion, the fixing portion being fixed to the main frame at a position where the second frame portion overlaps with the first frame portion.

9 Claims, 10 Drawing Sheets

| | FIRST EXEMPLARY EMBODIMENT | RELATED ART |
|---|---|---|
| SHAPE |   |   |
| CHANGE AMOUNT [mm] | 0.031 | 0.329 |
| IMPROVEMENT RATE [%] | 90.6 | – |

FRAME COUPLING STRUCTURE AND RECORDING DEVICE

The present application is based on, and claims priority from JP Application Serial Number 2020-216423, filed Dec. 25, 2020, the disclosure of which is hereby incorporated by reference herein in its entirety.

BACKGROUND

1. Technical Field

The present disclosure relates to a frame coupling structure and a recording device.

2. Related Art

Recently, a recording device that records a character, an image, etc. on a recording medium are known. Such a recording device is configured into a frame in which a plurality of sheet metals are coupled in a frame shape. For example, in FIG. 5 of JP-A-8-326719, in a case where two sheet metal are fixed at a right angle, a frame coupling structure is illustrated in which a sheet metal having a mounting portion bent in a substantially L shape is fixed using a screw on an upper surface of one the sheet metals.

However, the coupling structure illustrated in FIG. 5 of JP-A-8-326719 is fixed at a position separated from a position where the two sheet metals meet at a right angle, so that there is a possibility that the frame can deform due to insufficient rigidity when an impact is applied to a device by dropping, etc.

SUMMARY

A frame coupling structure includes a main frame extending in a first direction, a side frame extending in a second direction that intersects with the first direction, the side frame being fixed to the main frame, and a supported member extending in the first direction and supported by the side frame, wherein the side frame includes a first frame portion extending in the second direction and a second frame portion extending from the first frame portion in the first direction, the second frame portion being in surface contact with the main frame, and in plan view from the second direction, an abutting portion that abuts the main frame is provided at the first frame portion and a fixing portion is provided at the second frame portion, the fixing portion being fixed to the main frame at a position where the second frame portion overlaps with the first frame portion.

A recording device includes a main frame extending in a first direction, a side frame extending in a second direction that intersects with the first direction, the side frame being fixed to the main frame, a guide member extending in the first direction and supported by the side frame, and a recording head mounted on a carriage that moves along the guide member, the recording head being configured to perform recording on a recording medium, wherein the side frame includes a first frame portion extending in the second direction and a second frame portion extending from the first frame portion in the first direction, the second frame portion being in surface contact with the main frame, and in plan view from the second direction, an abutting portion that abuts the main frame is provided at the first frame portion and a fixing portion is provided at the second frame portion, the fixing portion being fixed to the main frame at a position where the second frame portion overlaps with the first frame portion.

DESCRIPTION OF EXEMPLARY EMBODIMENTS

1. First Exemplary Embodiment

Figure 1:
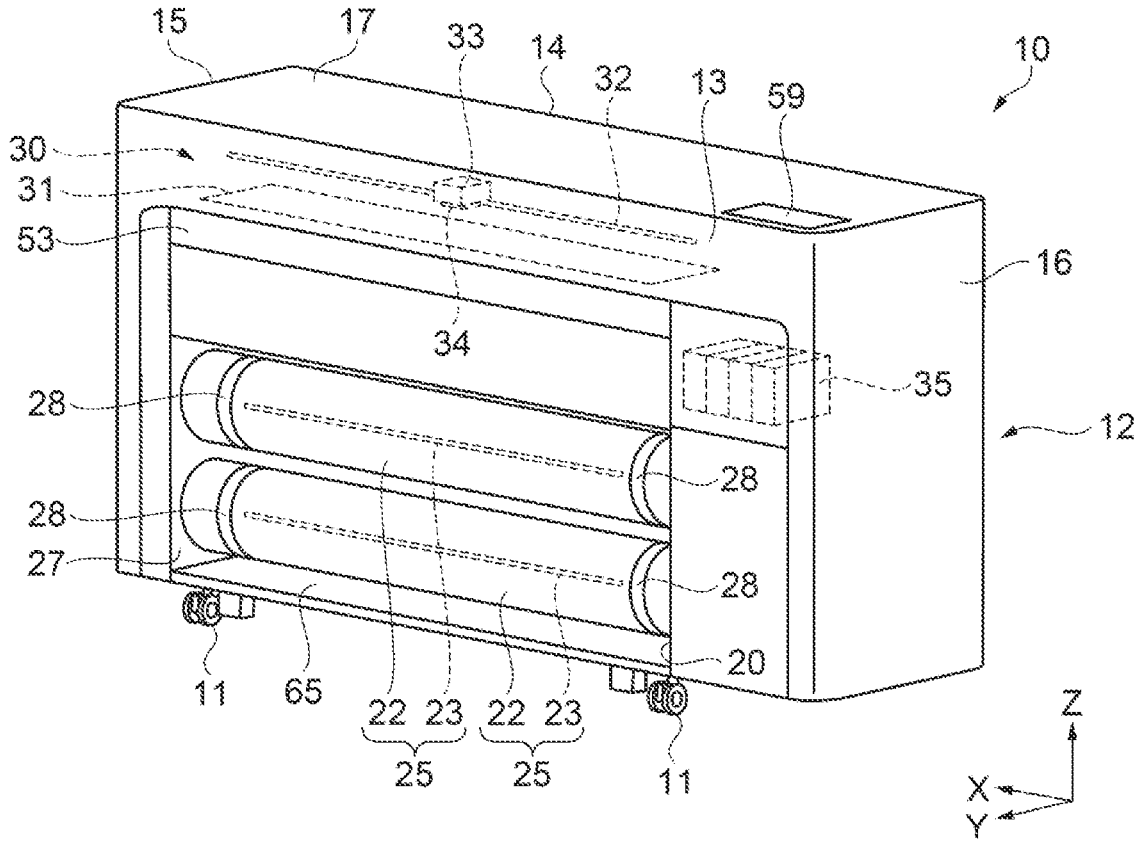
FIG. 1 is a perspective view illustrating a schematic configuration of a recording device according to a first exemplary embodiment.

A schematic configuration of a recording device according to a first exemplary embodiment will be described with reference to the drawings. As for the coordinates illustrated in the drawings, assuming that a recording device 10 is placed at a horizontal installation surface, the three virtual axes orthogonal to each other are defined as the X-axis, the Y-axis, and the Z-axis. The X-axis is a virtual axis parallel to a left-right direction of the recording device 10 corresponding to a first direction. The Y-axis is a virtual axis parallel to a front-rear direction of the recording device 10, corresponding to a second direction. The Z axis is a virtual axis parallel to the height direction of the recording device 10. The tip side of the arrows representing the X-axis, Y-axis, and Z-axis is the "+side", and the base end side is the "−side". The recording device 10 illustrated in the present exemplary embodiment is a large-format printer that feeds a long medium wound in a roll shape and performs recording by an ink-jet method. The large-format printer is a printer capable of performing recording on a long medium having a width of 297 mm or more, which corresponds to the short side width of A3-size sheets.

Figure 2:
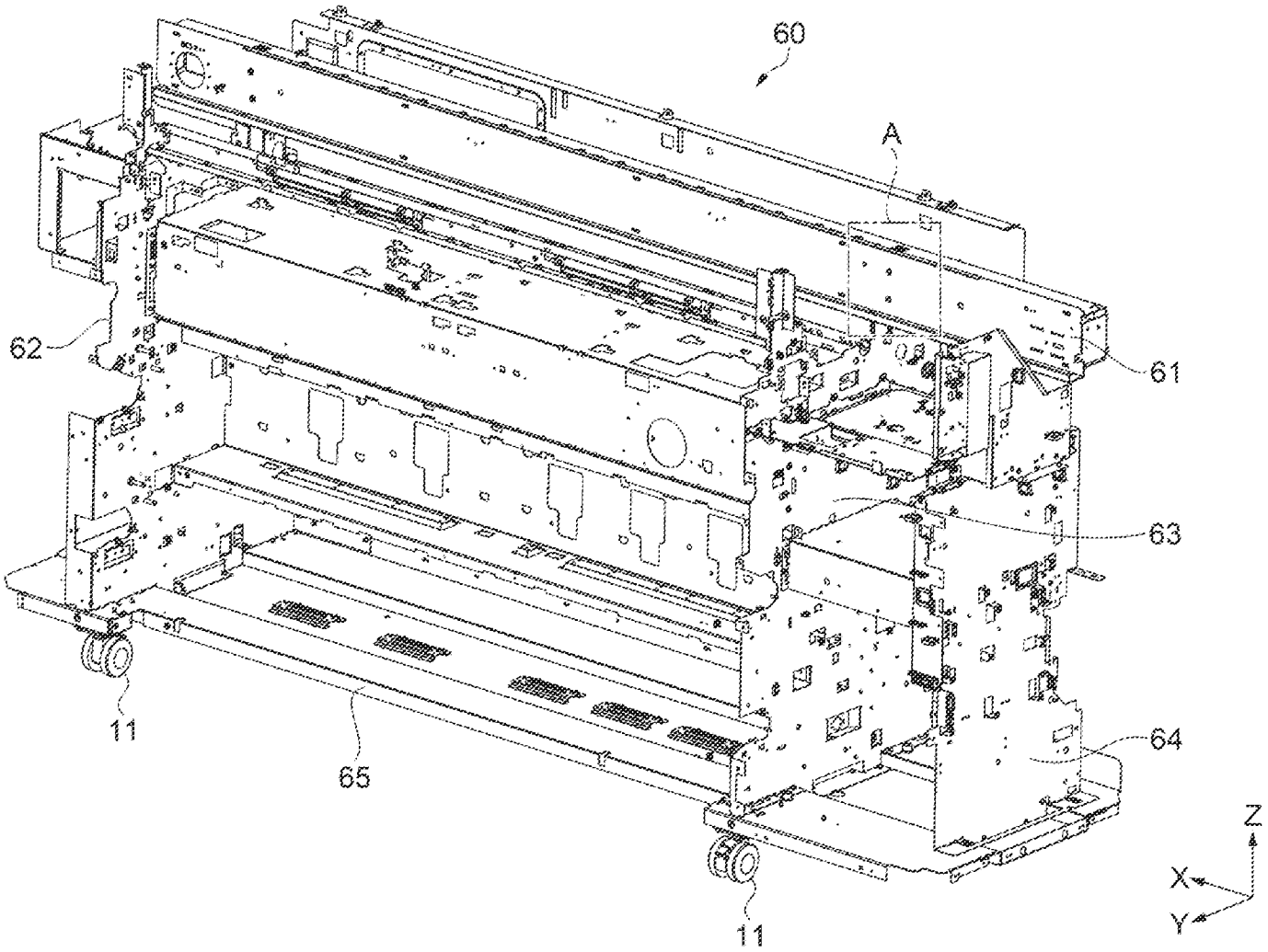
FIG. 2 is a cross-sectional view illustrating a configuration of a frame of the recording device.
Figure 3:
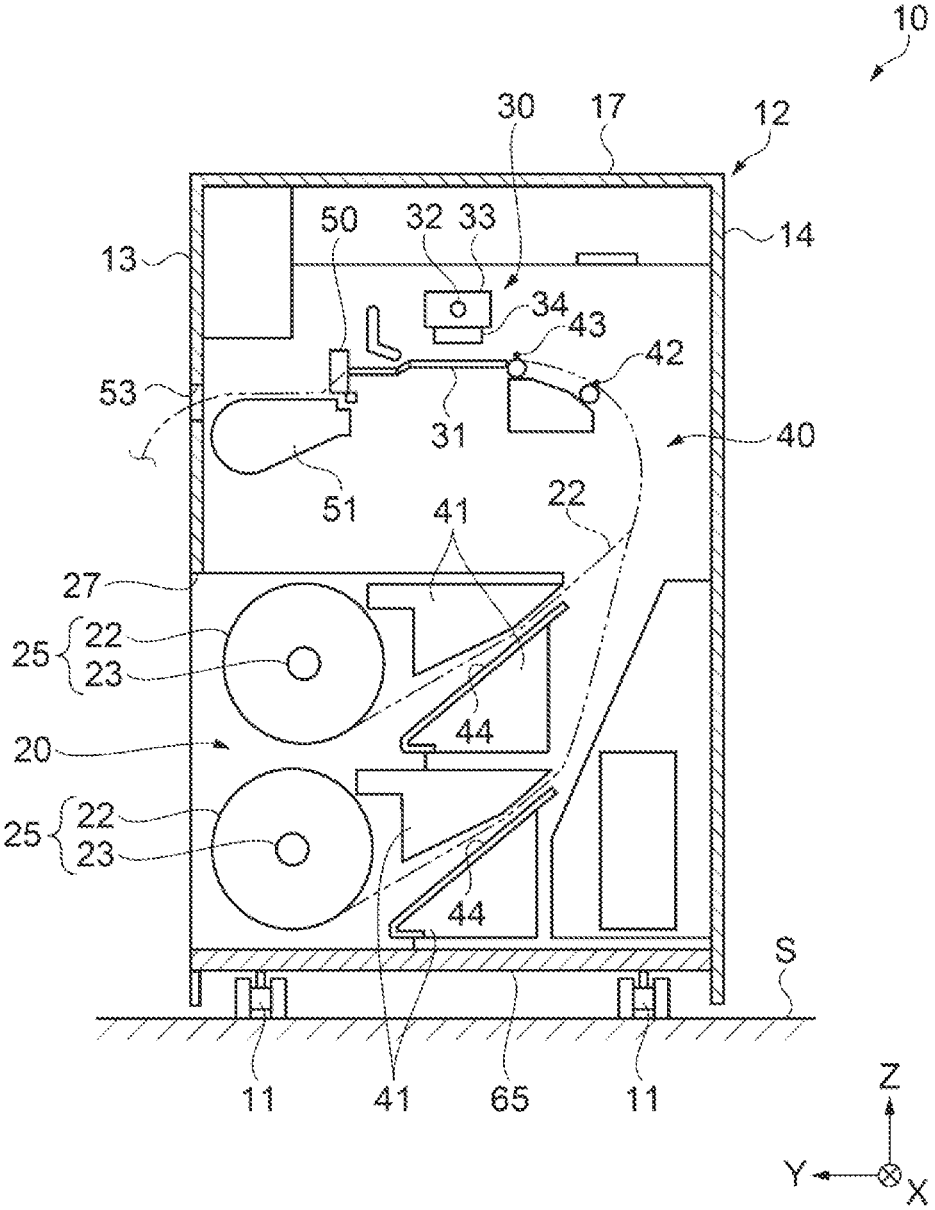
FIG. 3 is a cross-sectional view illustrating an internal configuration of the recording device.

As illustrated in FIGS. 1, 2 and 3, the recording device 10 is installed at an installation surface S via a leg portion 11. The recording device 10 has a substantially rectangular parallelepiped housing 12 that is long in the X direction. The housing 12 has a front wall 13, a rear wall 14, a first side wall 15, a second side wall 16, and an upper wall 17. In the recording device 10, a direction in which a base frame 65 and the upper wall 17 face each other is the height direction of the recording device 10. A direction in which the first side wall 15 and the second side wall 16 face each other is the left-right direction of the recording device 10. A direction in which the front wall 13 and the rear wall 14 face each other is the front-rear direction of the recording device 10. The housing 12 is coupled to a frame 60 supported by the leg portion 11.

The frame 60 is constituted by a main frame 61, a first side frame 62, a second side frame 63, a subframe 64, a base frame 65, etc.

The main frame 61 is a hollow substantially cuboid shaped member extending in the X direction and having an X-Z plane formed by the X-axis and the Z-axis. The main frame 61 is disposed along the upper wall 17 at an upper end portion of the frame 60. The main frame 61 of the present exemplary embodiment is constituted by a cold-rolled steel plate having a plate thickness of 1.2 mm.

The first side frame 62 and the second side frame 63 are plate-like members extending in the Y direction and having a Y-Z plane formed by the Y-axis and the Z-axis. The first side frame 62 and the second side frame 63 constitute a pair of side frames that are fixed to the main frame 61 at a predetermined interval in the X direction. The first side frame 62 is provided at a position along the first side wall 15. The main frame 61 is coupled to the upper end portions of the first side frame 62 and the second side frame 63. The first and second side frames 62, 63 of the present exemplary embodiment are constituted by an electrogalvanized steel plate having a plate thickness of 1.2 mm.

The base frame 65 is a plate-like member extending in the X direction and having an X-Y plane formed by an X-axis and a Y-axis. Lower end portions of the first side frame 62 and the second side frame 63 are coupled to an upper surface of the base frame 65. A plurality of legs portions 11 are coupled to a lower surface of the base frame 65.

The subframe 64 is a plate-like member provided parallel to the second side frame 63. The subframe 64 is provided at a position opposite the first side frame 62 and along the second side wall 16 with respect to the second side frame 63. The lower end portion of the subframe 64 is coupled to the upper face of the base frame 65. The upper end portion of the subframe 64 is coupled to a side surface of the second side frame 63 via a frame having an X-Y plane.

Inside the housing 12, provided are a recording unit 30 having a recording head 34 for performing recording on a recording medium 22, an accommodation unit 20 for accommodating a roll body 25 at which the recording medium 22 is wound in a cylindrical shape, a transport unit 40 for transporting the recording medium 22, and a cutting unit 50 for cutting the recording medium 22.

A plurality of openings is formed in the front wall 13 of the housing 12. A roll body accommodating port 27 for accommodating the roll body 25 is formed at the base frame 65 side below the front wall 13. In addition, a paper ejection port 53 for ejecting the recording medium 22 recorded is formed on the upper side of the roll body accommodating port 27.

The accommodation unit 20 is located between the pair of first and second side frames 62, 63. The cylindrical roll body 25 formed by winding the recording long recording medium 22 around a core member 23 is accommodated in the accommodation unit 20 so as to be detachable from the roll body accommodation port 27. In the present exemplary embodiment, the accommodation unit 20 is configured to accommodate two roll bodies 25 that are long in the X direction in a state of being arranged in the Z direction. A pair of holding members 28 that holds the roll body 25 rotatably with respect to the accommodation unit 20 is attached to both ends of the roll body 25. When the roll body 25 is rotationally driven, the recording medium 22 wound around the roll body 25 is delivered to the rear wall 14 side inside the housing 12.

The transport unit 40 transports the recording medium 22 delivered from the roll body 25. The transport unit 40 includes a transport path forming unit 41, an intermediate roller 42, and a transport roller 43.

The transport path forming unit 41 is provided corresponding to each of the two roll bodies 25. The transport path forming unit 41 is located on the rear wall 14 side with respect to each of the two roll bodies 25 accommodated in the accommodation unit 20. The transport path forming unit 41 forms a transport path 44 that guides the recording medium 22 delivered from the roll body 25 toward the rear wall 14 side of the housing 12 by the rotational driving of the roll body 25.

The intermediate roller 42 and the transport roller 43 transport the recording medium 22 having passed through the transport path 44 to the recording unit 30. The intermediate roller 42 and the transport roller 43 are supported by the first and second side frames 62, 63 rotatably about an axis along the X direction as the rotation axis. The intermediate roller 42 and the transport roller 43 are constituted by a driving roller and a driven roller. The recording medium 22 is sandwiched between the driving roller and the driven roller from both the front and back sides. When the driving rollers of the intermediate roller 42 and the transport roller 43 are rotationally driven, the recording medium 22 is transported to a support 31 through the transport path 44 and is transported on the support 31 from the rear wall 14 side to the front wall 13 side. Note that FIG. 3 illustrates a state in which the recording medium 22 is delivered from both of the two roll bodies 25, but during actual recording, the recording medium 22 is delivered from either one of the two roll bodies 25.

The recording unit 30 includes the support 31, a guide member 32, a carriage 33, and a recording head 34.

The support 31 is a plate-like member extending in the X direction in the housing 12, and is supported by the first and second side frames 62, 63. The support 31 is located closer to the upper wall 17 side than the accommodation unit 20, and supports the recording medium 22 transported by the transport unit 40.

The guide member 32 is a rod-shaped member extending in the X direction. The guide member 32 is located closer to the upper wall 17 side than the support 31, and slidably supports the carriage 33. The guide member 32 is provided along the base frame 65. The guide member 32 is an example of a supported member that extends in the X direction and is supported by the pair of first and second side frames 62, 63.

The recording head 34 is mounted on the carriage 33 that moves along the guide member 32. The recording head 34 is located on the support 31 side with respect to the carriage 33. The recording head 34, together with the carriage 33, is configured to perform reciprocally movement along the guide member 32. The recording head 34 is coupled to the cartridge 35 accommodating ink by a flexible tube (not illustrated). The cartridge 35 is accommodated at a position between the second side frame 63 and the subframe 64, the position being closer to the upper wall 17 side than the accommodation unit 20. The recording head 34 performs recording on the recording medium 22 by discharging ink onto the recording medium 22 supported by the support 31 while moving in the X direction.

The cutting unit 50 is located closer to the front wall 13 side than the recording unit 30. The cutting unit 50 has a fixed blade and a movable blade movable with respect to the fixed blade, and cuts the recording medium 22 located between the fixed blade and the movable blade. The cut recording medium 22 is supported by a paper ejection port member 51 that guides the recording medium 22 to the paper ejection port 53 formed at the front wall 13, and is ejected to the outside of the housing 12.

The recording device 10 includes an input unit 59. The input unit 59 is provided at an upper surface of the upper wall 17 of the housing 12. The input unit 59 is located at a corner formed by a portion where the front wall 13 is coupled to the upper wall 17 and a portion where the second side wall 16 is coupled to the upper wall 17. The input unit 59 is configured, for example, by a liquid crystal display device including a touch panel, and is used when a user inputs various types of information.

Next, a coupling structure between the main frame 61 and the second side frame 63 will be described. Note that the coupling structure between the main frame 61 and the first side frame 62 is the same as the coupling structure of the main frame 61 and the second side frame 63, and thus description thereof will be omitted.

Figure 4:
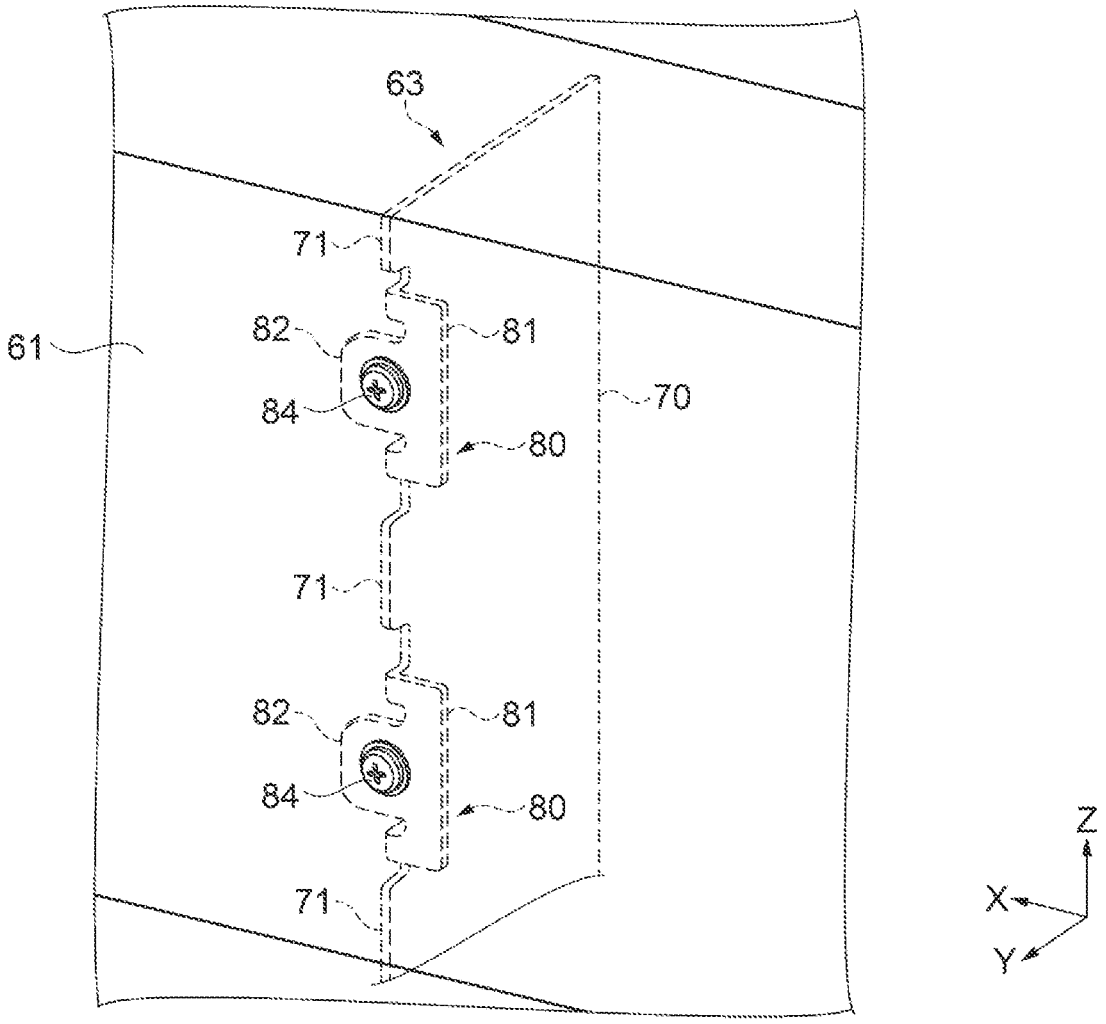
FIG. 4 is an enlarged view illustrating a portion A in FIG. 2 at an enlarged scale.
Figure 5:
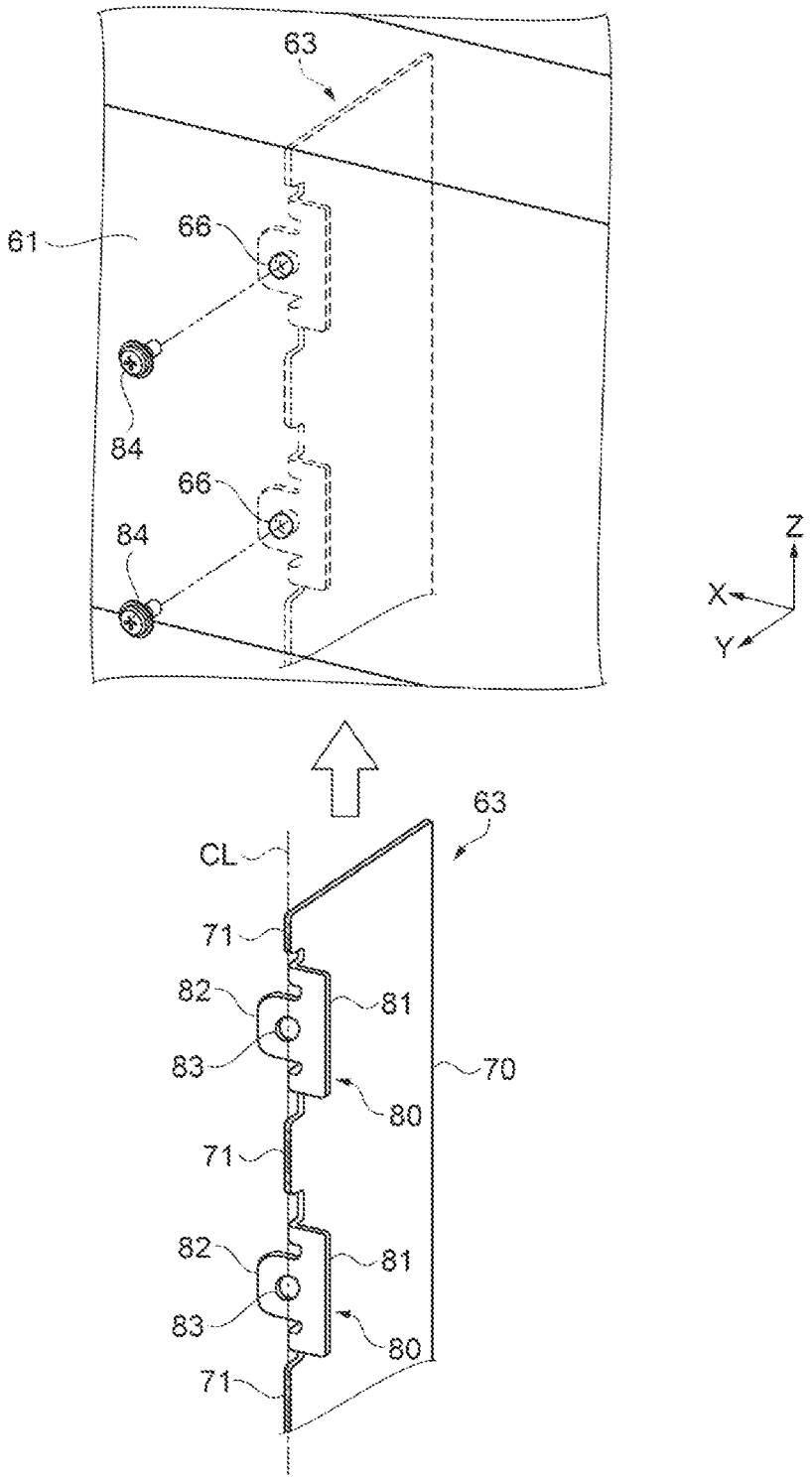
FIG. 5 is a perspective view illustrating a coupling structure between a main frame and a side frame.
Figure 6:
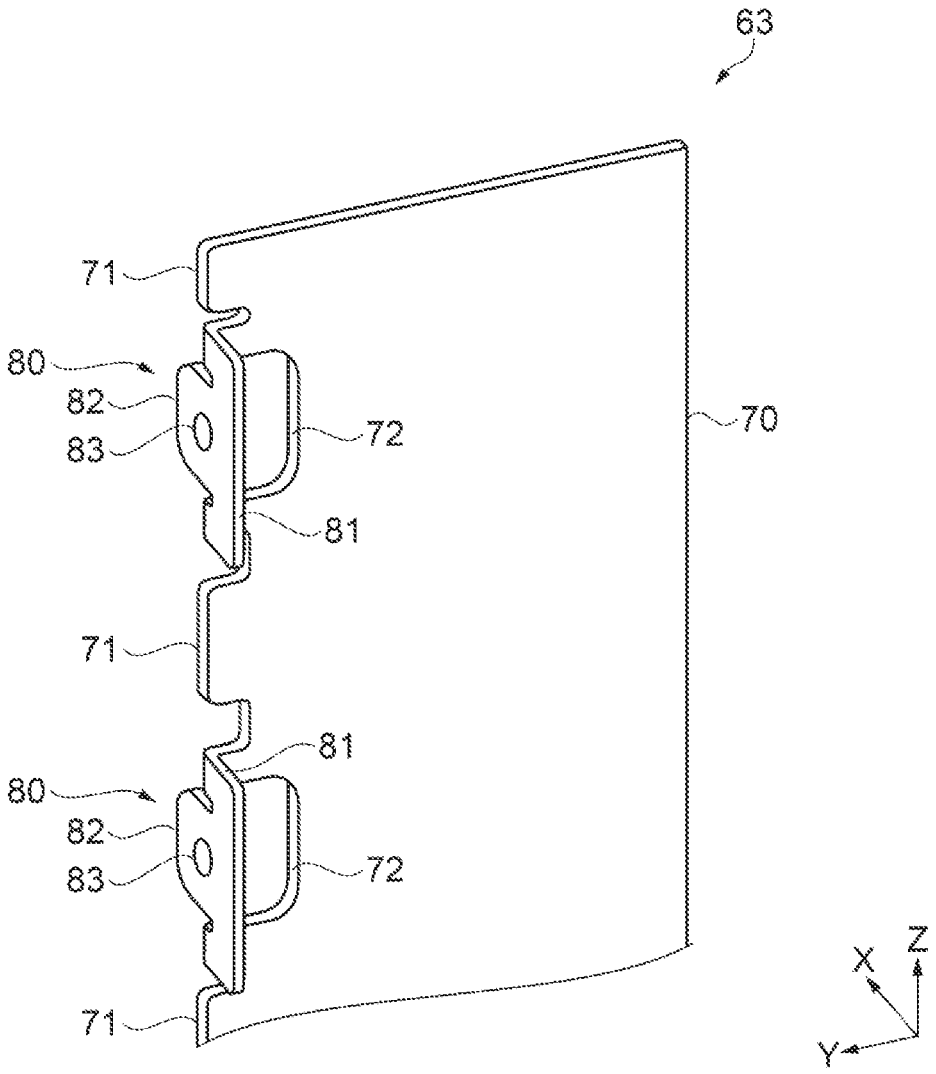
FIG. 6 is a perspective view illustrating a configuration of the side frame.

As illustrated in FIGS. 4 to 6, the second side frame 63 includes a first frame portion 70 extending in the Y direction, and a second frame portion 80 extending in the X direction from an end surface in the +Y direction of the first frame portion 70. The first frame portion 70 is a plate-like member having a Y-Z plane formed by the Y-axis and the Z-axis. The second frame portion 80 is formed by a bending process of a portion of the plate-like member having the Y-Z plane including the first frame portion 70. A plurality of the second frame portions 80 are provided at the first frame portion 70. The present exemplary embodiment illustrates a configuration in which two second frame portions 80 are provided at the first frame portion 70. One second frame portion 80 of the two frames is located on an upper end side of the first frame portion 70, and the other second frame portion 80 is located at a position separated downward from the one second frame portion 80.

When the second side frame 63 is viewed in plan view from the +Y direction, an abutting portion 71 that abuts the main frame 61 is provided at the first frame portion 70. The abutting portion 71 is an end surface capable of abutting the main frame 61. A plurality of the abutting portions 71 are provided at an end surface of the first frame portion 70 on the +Y side. The second frame portion 80 includes a first extending portion 81 extending from between the abutting portions 71 provided at the end surface on the +Y side of the first frame portion 70 to the −X side as one side along the first direction, and a second extending portion 82 extending from the end surface on the +X side of the first extending portion 81 to the +X side as the other side along the first direction.

The first extending portion 81 is a plate-like member that is long in the Z direction having an X-Z plane formed by the X-axis and the Z-axis. The length thereof in the Z direction is approximately 20 mm.

The second extending portion 82 is a plate-like member that is long in the Z direction having an X-Z plane formed by the X-axis and the Z-axis. The length of the second extending portion 82 in the Z direction is approximately 10 mm. The end surface of the second extending portion 82 on the −X side is coupled to an end surface of a central portion of the first extension portion 81 on the +X side in the Z direction.

The first extending portion 81 of the second frame portion 80 is coupled to the first frame portion 70. The end surfaces on the +X side of the first extending portion 81 adjacent to the upper and lower sides of the second extending portion 82 in the second frame portion 80 via a gap therebetween, are coupled to the end surface of the +Y side of the first frame portion 70 with a coupling width of approximately 3 mm.

Note that, in the present exemplary embodiment, for convenience of explanation, the first extending portion 81 and the second extending portion 82 are coupled. However, in reality, these portions are integrally formed by bending a plate-shaped member.

Two of the second frame portions 80 including one fixing portion 83 are coupled to the first frame portion 70 of the present exemplary embodiment.

When the second side frame 63 is viewed in plan view from the +Y direction, a fixing portion 83 fixed to the main frame 61 at a position where the second frame portion 80 overlaps with the first frame portion 70, is provided at the second frame portion 80. Specifically, in each of the second frame portions 80, the fixing portion 83 is formed at a midpoint of the second extending portion 82 in the Z direction, the midpoint being a boundary between the first extending portion 81 and the second extending portion 82 in the X direction. In plan view from the +Y direction, the fixing portion 83 is located at a position where the fixing portion 83 overlaps with the plate thickness of the first frame portion 70, and where the abutting portion 71 and the fixing portion 83 are arranged on a straight line CL along the Z direction. The fixing portion 83 of the present exemplary embodiment is a female screw. The female screw is formed by threading the inner periphery of the through-hole that penetrates the second frame portion 80 in the Y direction.

As illustrated in FIG. 5, the upper end portion of the second side frame 63 including the first frame portion 70 and the second frame portion 80 is inserted into the hollow main frame 61 from below the main frame 61. As a result, the side surface on the +Y side of the X-Z plane of the second frame portion 80 is in surface contact with the inner side surface on the −Y side of the X-Z plane of the main frame 61. A communication hole 66 that communicates with the fixing portion 83 formed at the second frame portion 80 is provided at the side surface on the +Y side of the main frame 61. The main frame 61 and the second side frame 63 are fixed by a male screw 84 that is screwed with the female screw as one example of the fixing portion 83 via the communicating hole 66. As illustrated in FIG. 6, a notch portion 72 is provided in the first frame portion 70 at a position facing the fixing portion 83, in order to prevent a tip of the male screw 84 that is screwed with the fixing portion 83 from interfering with the first frame portion 70.

Here, a configuration of the second side frame 363 according to the related art will be described.

Figure 10:
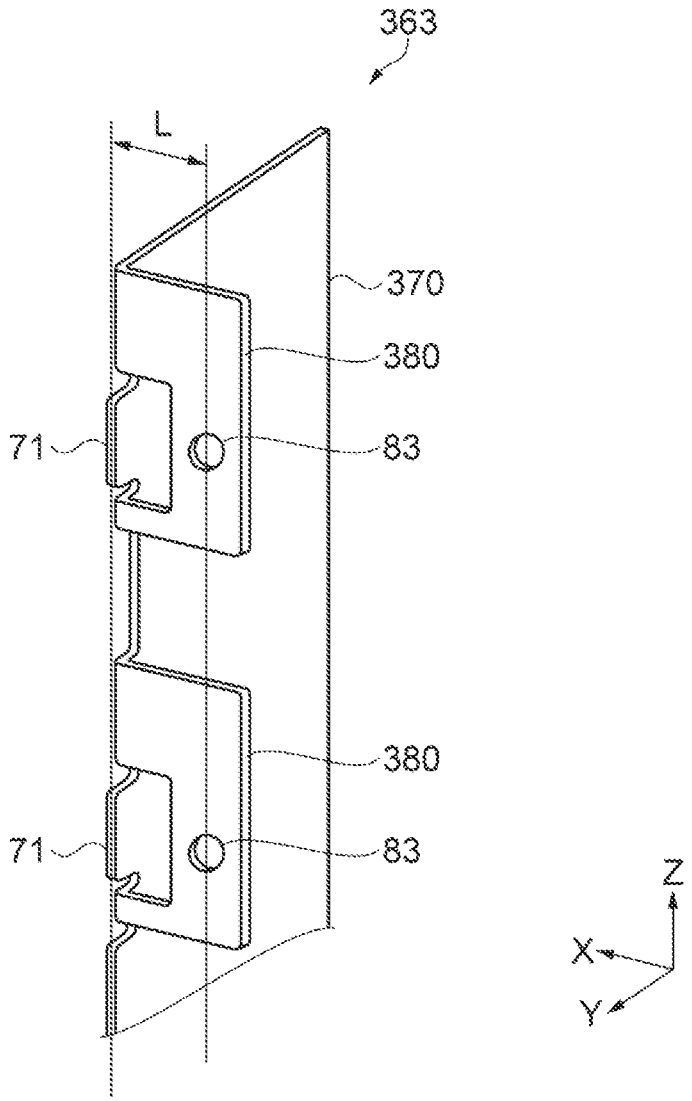
FIG. 10 is a perspective view illustrating a configuration of a side frame according to a related art.

As illustrated in FIG. 10, the second side frame 363 includes a first frame portion 370 extending in the Y direction, and a second frame portion 380 extending in the −X direction from an end portion in the +Y direction of the first frame portion 370. The first frame portion 370 is a plate-like member having a Y-Z plane. The second frame portion 380 is formed by a bending process of a portion of the plate-like member having the Y-Z plane including the first frame portion 370. A plurality of the second frame portions 380 are provided at the first frame portion 370.

When the second side frame 363 is viewed in plan view from the +Y direction, an abutting portion 71 that abuts the main frame 61 is provided at the first frame portion 370. The abutting portion 71 is an end surface that is capable of abutting the main frame 61. A plurality of the abutting portions 71 are provided at an end surface of the first frame portion 370 on the +Y side.

The second frame portion 380 is a plate-like member that is long in the Z direction having an X-Z plane formed by the X-axis and the Z-axis. The length of the second frame portion 380 in the Z direction is approximately 25 mm. The end surfaces on the +X side at the upper end portion and the lower end portion of the second frame portion 380 are coupled to the end surfaces of the +Y side adjacent to the upper and lower sides of the abutting portion 71 in the first frame portion 370 via a gap therebetween. The upper end portion of the second frame portion 380 is coupled to the first frame portion 370 at a coupling width of approximately 12 mm. The lower end portion of the second frame portion 380 is coupled to the first frame portion 370 at a coupling width of approximately 3 mm.

When the second side frame 363 is viewed in plan view from the +Y direction, the fixing portion 83 is provided in the second frame portion 380 at a position separated in the −X direction from the abutting portion 71 of the first frame portion 370. A separation distance L along the X direction between the fixing portion 83 and the abutting portion 71 is approximately 10 mm. The main frame 61 and the second side frame 363 are fixed by the male screw 84 that is screwed with the fixing portion 83 via the communicating hole 66.

In a state in which the main frame 61 and the second side frame 363 are fixed, the entire frame 60 including the main frame 61 may be deformed due to insufficient rigidity of the second frame portion 380, for example, when an impact caused by dropping of the device, etc. is applied. It is considered that this is because the main frame 61 and the first frame portion 370 of the second side frame 363 are fixed at a position separated from the abutting portion 71 intersecting at a right angle. Therefore, the inventors conceived the shape of the second side frame 63 described above, and evaluated the rigidity thereof.

Figure 7:
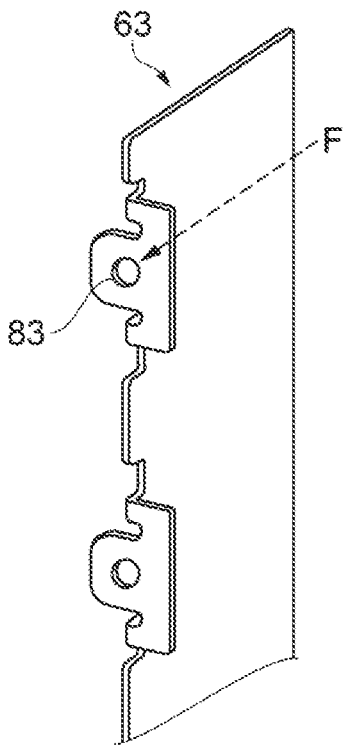
FIG. 7 is a diagram illustrating an amount of deformation and an improvement rate of the side frame.
Figure 7:
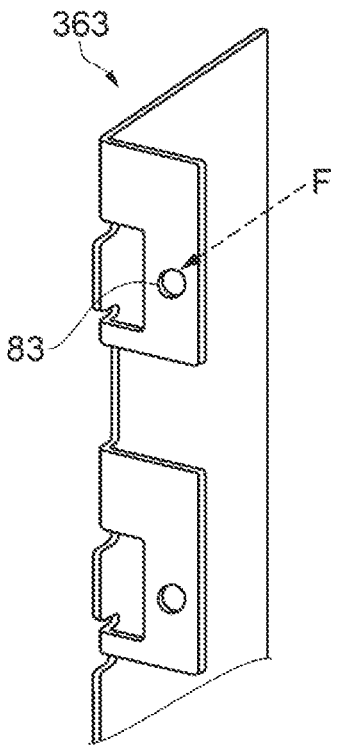

FIG. 7 illustrates each amount of deformation when a force F is applied to the second side frame 63 described in the first exemplary embodiment and the second side frame 363 described as the related art, and an improvement rate of the amount of deformation of the second side frame 63 with respect to the amount of deformation of the second side frame 363. The amount of deformation illustrated in FIG. 7 illustrates the amount of deformation of the fixing portion 83 that occurs when the force F of 100N along the +Y direction is applied to the fixing portion 83 by simulation using a finite element method.

As a result of the simulation, the amount of deformation of the fixing portion 83 of the second side frame 363 described in the related art was 0.329 mm. The amount of deformation of the fixing portion 83 of the second side frame 63 described in the first exemplary embodiment was 0.031 mm, so that the improvement rate reached 90.6%. As a result, it was confirmed that the configuration of the second side frame 63 described in the first exemplary embodiment can significantly improve the rigidity of the second side frame 363 described in the related art.

Note that, in the present exemplary embodiment, the configuration in which the two second frame portions 80 extend from the first frame portion 70 is illustrated, but the number of the second frame portions 80 may be one or three or more. Additionally, the first side frame 62 and the second side frame 63 may have the same shape or may have a shape that is asymmetric about the Z-axis. Furthermore, the method for fixing the main frame 61 and the first and second side frames 62, 63 may be a method for fixing by riveting, spot welding, etc., in addition to being screwed by the male screw 84.

As described above, according to the frame coupling structure and the recording device 10 according to the first exemplary embodiment, the following effects can be obtained.

The frame coupling structure includes the main frame 61 extending in the X direction and the pair of side frames extending in the Y direction and fixed to the main frame 61. Furthermore, the first and second side frames 62, 63 constituting the pair of side frames include the first frame portion 70 extending in the Y direction, and the second frame portion 80 extending in the X direction from the first frame portion 70 and in surface contact with the main frame 61. In plan view from the Y direction, the main frame 61 abuts in a T shape with the abutting portion 71 provided at the first frame portion 70 of the first and second side frames 62, 63. The main frame 61 is fixed by the fixing portion 83 provided at the second frame portion 80. The fixing portion 83 overlaps with the first frame portion 70 in plan view from the Y direction. In other words, the abutting portion 71 and the fixing portion 83 are located at positions aligned on the straight line CL along the Z direction. As a result, the rigidity of the first and second side frames 62, 63 is improved, so that deformation of the frame 60 caused by the impact can be suppressed.

The second frame portion 80 includes the first extending portion 81 extending to one side along the X direction and the second extending portion 82 extending to the other side. As a result, the fixing portion 83 can be easily provided at a position where the fixing portion 83 overlaps with the first frame portion 70 in plan view from the Y direction.

The second frame portion 80 is provided between a plurality of the abutting portions 71 provided at the first frame portion 70. As a result, the effect of suppressing deformation of the frame 60 due to impact can be improved.

A plurality of the second frame portions 80 are provided at the first frame portion 70. As a result, the effect of suppressing deformation of the frame 60 due to impact can be improved.

The notch portion 72 is provided in the first frame portion 70 at a position facing the fixing portion 83. As a result, for example, the tip of the male screw 84 that is screwed with the fixing portion 83 interferes with the first frame portion 70, and it is possible to suppress the incomplete fixing of the main frame 61 and the first and second side frames 62, 63.

The second frame portion 80 is formed by the bending process. As a result, the first frame portion 70 and the second frame portion 80 can be easily configured from one sheet metal.

The recording device 10 includes the main frame 61 extending in the X direction, the first and second side frames 62, 63 that constitute the pair of side frames that extend in the Y direction and are fixed to the main frame 61, the guide member 32 supported by the first and second side frames 62, 63, and the recording head 34 that moves along with the carriage 33 along the guide member 32 to perform recording. Furthermore, the first and second side frames 62, 63 include the first frame portion 70 extending in the Y direction, and the second frame portion 80 extending in the X direction from the first frame portion 70 and in surface contact with the main frame 61. In plan view from the Y direction, the main frame 61 abuts in a T shape with the abutting portion 71 provided at the first frame portion 70 of the first and second side frames 62, 63, and is fixed by the fixing portion 83 provided at the second frame portion 80.

The fixing portion 83 overlaps with the first frame portion 70 in plan view from the Y direction. In other words, the abutting portion 71 and the fixing portion 83 are located at positions aligned on the straight line CL along the Z direction. As a result, the rigidity of the first and second side frames 62, 63 is improved, and it is possible to provide the recording device 10 that suppresses deformation of the frame 60 caused by the impact.

2. Second Exemplary Embodiment

A schematic configuration of a second side frame according to a second exemplary embodiment will be described. A second side frame 163 of the present exemplary embodiment includes a second frame portion 180 at which a plurality of the fixing portions 83 are provided. Note that configurations identical to those in the first exemplary embodiment will be denoted by the same reference signs and redundant descriptions will be omitted.

Figure 8:
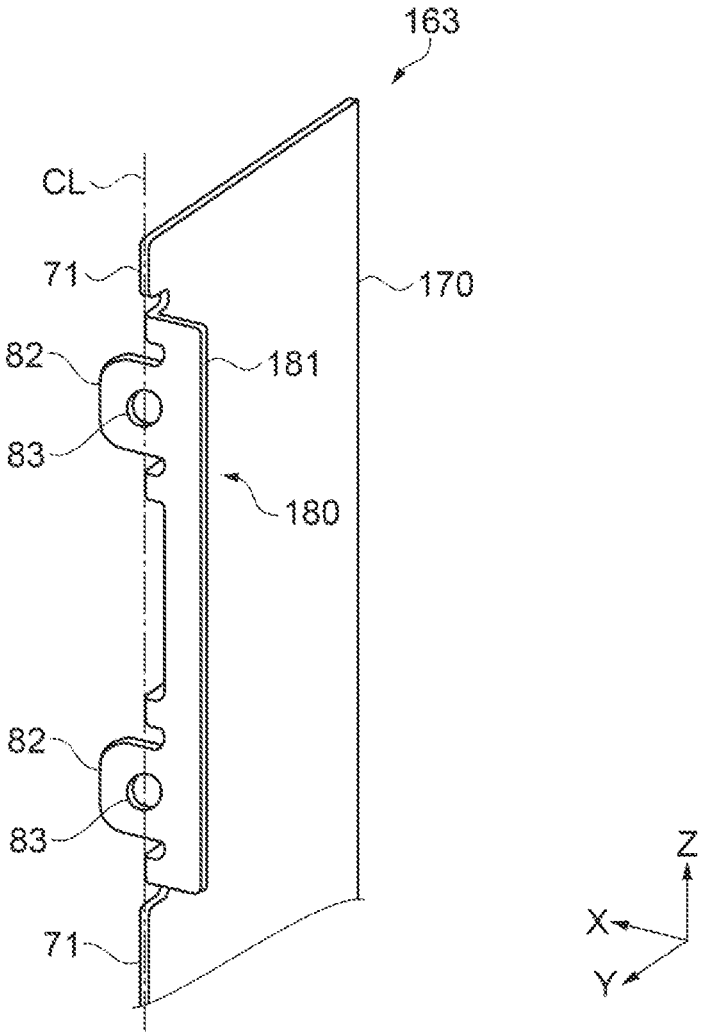
FIG. 8 is a perspective view illustrating a configuration of a side frame according to a second exemplary embodiment.

As illustrated in FIG. 8, the second side frame 163 includes a first frame portion 170 extending in the Y direction, and a second frame portion 180 extending in the X direction from an end portion in the +Y direction of the first frame portion 170. The first frame portion 170 is a plate-like member having a Y-Z plane. The second frame portion 180 is formed by a bending process of a portion of the plate-like member having the Y-Z plane including the first frame portion 170. One second frame portion 180 is provided at the first frame portion 170.

When the second side frame 163 is viewed in plan view from the +Y direction, an abutting portion 71 that abuts the main frame 61 is provided at the first frame portion 170. A plurality of the abutting portions 71 are provided at an end surface of the first frame portion 170 on the +Y side. The second frame portion 180 includes a first extending portion 181 extending from between the abutting portions 71 provided at the end surface of the first frame portion 170 on the +Y side to the −X side, and a second extending portion 82 extending from the end portion on the +X side of the first extending portion 181 to the +X side. A plurality of the second extending portions 82 are provided with respect to the first extending portion 181. The present exemplary embodiment illustrates a configuration in which two second extending portions 82 that are separated in the vertical direction are provided at the first extending portion 181.

The first extending portion 181 is a plate-like member that is long in the Z direction having an X-Z plane formed by the X-axis and the Z-axis. The length thereof in the Z direction is approximately 62 mm. One of the two second extending portions 82 is located on the upper end side of the first extending portion 181, and the other is located on the lower end side of the first extending portion 181.

The first extending portion 181 of the second frame portion 180 is coupled to the first frame portion 170. The end surfaces on the +X side of the first extending portion 181 adjacent to the upper and lower sides of each second extending portion 82 in the second frame portion 180 via a gap therebetween, are coupled to the end surface of the +Y side of the first frame portion 170 with a coupling width of approximately 3 mm. Note that, in the present exemplary embodiment, for convenience of explanation, the first extending portion 181 and the second extending portion 82 are coupled. However, in reality, these portions are integrally formed by bending a plate-shaped member.

One second frame portion 180 including a plurality of fixing portions 83 is coupled to the first frame portion 170. The second frame portion 180 of the present exemplary embodiment includes two fixing portions 83.

When the second side frame 163 is viewed in plan view from the +Y direction, a fixing portion 83 fixed to the main frame 61 at a position where the second frame portion 180 overlaps with the first frame portion 170, is provided at the second frame portion 180. Specifically, in the second frame portion 180, the fixing portion 83 is formed at a midpoint of each second extending portion 82 in the Z direction, the midpoint being a boundary between the first extending portion 181 and the second extending portion 82 in the X direction. In plan view from the +Y direction, the fixing portion 83 is located at a position where the fixing portion 83 overlaps with the plate thickness of the first frame portion 170, and where the abutting portion 71 and the fixing portion 83 are arranged on a straight line CL along the Z direction.

Similar to the first exemplary embodiment, the amount of deformation of the fixing portion 83 that occurs when the force F of 100N along the +Y direction is applied to the fixing portion 83 of the second side frame 163 was calculated by simulation. As a result, the amount of deformation of the fixing portion 83 of the second side frame 163 was 0.024 mm, so that the improvement rate reached 92.7%. As a result, it was confirmed that the configuration of the second side frame 163 described in the second exemplary embodiment has a higher rigidity than the second side frame 63 described in the first exemplary embodiment.

Note that the configuration of the second side frame 163 including the two fixing portions 83 is illustrated in the present exemplary embodiment, however, the second side frame may include three or more fixing portions 83.

As described above, according to the frame coupling structure according to the second exemplary embodiment, the following effects can be obtained.

The plurality of fixing portions 83 are provided at the second frame portion 180. As a result, the effect of suppressing deformation of the frame 60 due to impact can be improved.

3. Third Exemplary Embodiment

A schematic configuration of a second side frame 263 according to a third exemplary embodiment will be described. The second side frame 263 of the present exemplary embodiment includes a plurality of second frame portions 80, 280 with different extending orientations. Note that configurations identical to those in the first exemplary embodiment will be denoted by the same reference signs and redundant descriptions will be omitted.

Figure 9:
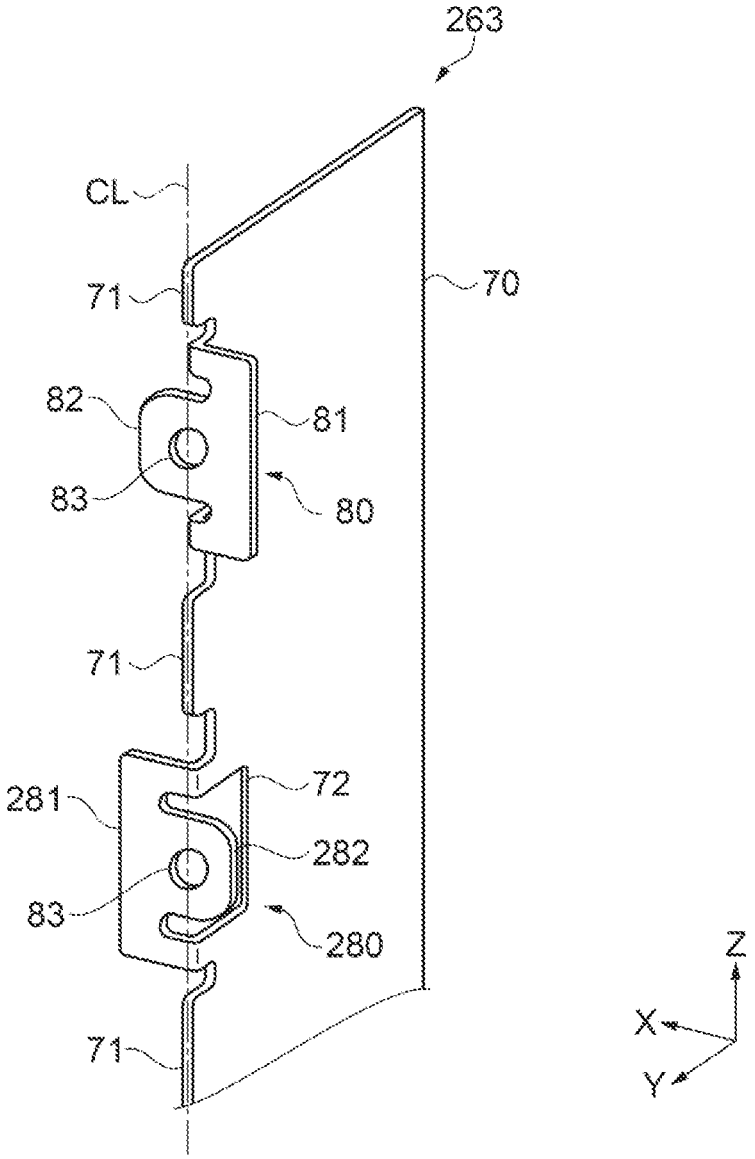
FIG. 9 is a perspective view illustrating a configuration of a side frame according to a third exemplary embodiment.

As illustrated in FIG. 9, the second side frame 263 includes the first frame portion 70, and the second frame portions 80, 280 that extend in the X direction from the end portion in the +Y direction of the first frame portion 70. In other words, the plurality of second frame portions 80, 280 are provided at the first frame portion 70. The second frame portions 80, 280 are formed by a bending process of a portion of the plate-like member having the Y-Z plane including the first frame portion 70. The second frame portion 80 is located on the upper end side of the first frame portion 70, and the second frame portion 280 is located at a position separated downward from the second frame portion 80.

At least one of the plurality of second frame portions 80, 280 extends from the first frame portion 70 along the X direction in an orientation different from an orientation of the other second frame portion. Specifically, the second frame portion 280 includes a first extending portion 281 extending from between the abutting portions 71 provided at the end surface on the +Y side of the first frame portion 70 to the +X side, and a second extending portion 282 extending from the end surface on the −X side of the first extending portion 281 to the −X side. In other words, the orientation of the second frame portion 280 extending from the first frame portion 70 is different from the orientation of the second frame portion 80. In other words, the second frame portion 280 is configured to be linearly symmetrical with respect to the straight line CL along the Z direction of the second frame portion 80.

As described above, according to the frame coupling structure according to the third exemplary embodiment, the following effects can be obtained.

The plurality of second frame portions 80, 280 are provided at the first frame portion 70, and at least one of the plurality of second frame portions 80, 280 extends from the first frame portion 70 along the X direction in the orientation different from the orientation of the other second frame portion. In this manner, by changing the orientation of the second frame portion 80 and the second frame portion 280 extending from the first frame portion 70, the effects of suppressing deformation of the frame 60 can be improved.

What is claimed is:

1. A frame coupling structure comprising:

a main frame extending in a first direction;

a side frame extending in a second direction that intersects with the first direction, the side frame being fixed to the main frame; and a supported member extending in the first direction and supported by the side frame, wherein the side frame includes a first frame portion extending in the second direction and a second frame portion extending from the first frame portion in the first direction, the second frame portion being in surface contact with the main frame, and in plan view from the second direction, an abutting portion that abuts the main frame is provided at the first frame portion and a fixing portion is provided at the second frame portion, the fixing portion being fixed to the main frame at a position where the second frame portion overlaps with the first frame portion, wherein a plurality of the abutting portions are provided at the first frame portion, and the second frame portion extends in the first direction from between the abutting portions.

2. The frame coupling structure according to claim 1, wherein a plurality of the side frames are disposed at a predetermined interval in the first direction.

3. The frame coupling structure according to claim 1, wherein the second frame portion includes a first extending portion extending from the first frame portion to one side along the first direction, and a second extending portion extending from the first extending portion to another side along the first direction.

4. The frame coupling structure according to claim 1, wherein a plurality of the fixing portions are provided at the second frame portion.

5. The frame coupling structure according to claim 1, wherein a plurality of the second frame portions are provided at the first frame portion.

6. The frame coupling structure according to claim 5, wherein at least one of the plurality of second frame portions extends along the first direction, from the first frame portion, toward a side different from a side toward which another second frame portion extends.

7. The frame coupling structure according to claim 1, wherein a notch portion is provided in the first frame portion at a position facing the fixing portion.

8. The frame coupling structure according to claim 1, wherein the second frame portion is formed by a bending process.

9. A recording device comprising:

a main frame extending in a first direction;

a side frame extending in a second direction that intersects with the first direction, the side frame being fixed to the main frame;

a guide member extending in the first direction and supported by the side frame; and a recording head mounted on a carriage that moves along the guide member, the recording head being configured to perform recording on a recording medium, wherein the side frame includes a first frame portion extending in the second direction and a second frame portion extending from the first frame portion in the first direction, the second frame portion being in surface contact with the main frame, and in plan view from the second direction, an abutting portion that abuts the main frame is provided at the first frame portion and a fixing portion is provided at the second frame portion, the fixing portion being fixed to the main frame at a position where the second frame portion overlaps with the first frame, wherein a plurality of the abutting portions are provided at the first frame portion, and the second frame portion extends in the first direction from between the abutting portions.

* * * * *